United States Patent [19]

Montgomery

[11] 3,986,626

[45] *Oct. 19, 1976

[54] THREADED CAP AND NECK FOR A LIQUID CONTAINER

[75] Inventor: Gary Van Montgomery, Evansville, Ind.

[73] Assignee: Sunbeam Plastics Corporation, Evansville, Ind.

[ * ] Notice: The portion of the term of this patent subsequent to July 27, 1993, has been disclaimed.

[22] Filed: Sept. 29, 1975

[21] Appl. No.: 617,521

Related U.S. Application Data

[63] Continuation-in-part of Ser. No. 596,979, July 18, 1975.

[52] U.S. Cl. ..... 215/216; 215/217; 215/224; 215/321

[51] Int. Cl.[2] ..... B65D 55/02; B65D 85/56; H61J 1/00

[58] Field of Search ..... 215/216, 224, 217, 218, 215/321

[56] References Cited

UNITED STATES PATENTS 3,679,084 7/1972 Aronson ..... 215/224

*Primary Examiner*—George T. Hall

*Attorney, Agent, or Firm*—Henry K. Leonard

[57] ABSTRACT

A combination threaded cap and neck finish for a liquid container having mating threads on the cap interior and the exterior of the neck and also having second cooperating cam means on the cap and the container neck for applying downward thrust to the cap to maintain liquid tight sealing of the container neck even when the cap is rotated in the loosening direction through an angle relative to the container neck so as to disengage the downward thrusting surfaces of the mating threads. Some embodiments of the invention also have child-resistant cooperating means which prevent removal of the cap unless such means are disengaged by a separate and different manipulation.

6 Claims, 22 Drawing Figures

THREADED CAP AND NECK FOR A LIQUID CONTAINER

This application is a continuation-in-part of my earlier filed co-pending application Ser. No. 596,979 filed July 18, 1975.

BACKGROUND OF THE INVENTION

Many child-resistant caps and closures have been suggested in recent years because of the greater activity directed toward insuring that dangerous and poisonous materials be packaged in containers which are significantly difficult for small children to open. At the same time, however, it is also necessary that the closures can be opened by an older child or an adult.

Many prior art closures of this general type are made child-resistant by the cooperative action of a radially or vertically extending tab carried by the cap and a lug formed on the shoulder or lower portion of the neck of the container against which the tab impinges when the child seeks to open the container by unscrewing the cap. Many of this type of child-resistant closures ignore a difficulty arising from the normal manufacturing tolerances which are present in both the cap and the bottle neck, in the threads on both, in the thickness of the liner or other sealing means interiorly of the cap, etc. When the tolerances which are built in during the manufacture accumulate, the result may be that, if the cap closes a container for liquids, when a small child endeavors to open the container, he may twist the cap in an opening direction a distance sufficient to create a leaking container.

The foregoing problems are particularly prevalent when the cap is a screw type cap and is so designed as to be placed upon the container by automatic capping machinery of the type used for capping ordinary screw caps. Preferably, a child-resistant closure should be of a type which can be handled by standard capping equipment so that many such closures are made of the screw type hopefully to enable automatic capping without the necessity for the person filling the containers to buy new capping equipment.

Particularly where the closures are of the type which comprise a disc-like liner interiorly of the cap, the compressibility of the liner enters into the question of whether or not the cap is turned on to the bottle neck to the proper distance both to seal the container and to place the child-resistant elements in child-resistant position. Because of the tolerances mentioned above, it therefore becomes necessary to so design the cap and the container neck to insure that when the cap is put on to the container neck, for example by an automatic torque-responsive capping machine, it will be turned on to the neck far enough to at least engage the child-resistant means. Usually, therefore, it is turned on to the neck a distance beyond the engagement of the child-resistant means in order to insure that the container is sealed.

The problem arises the second time after the container has once been opened by an adult or older child who has then restored the cap to reseal the container. If this person turns the cap on to the neck of the container only until the child-resistant elements reach their engaging position, the cap may not be turned on to the neck tightly enough to prevent the container from leaking. If the person turns the cap on to the container neck sufficiently far to insure that it is sealed against leakage, the child-resistant means are spaced from each other, and a small child may rotate the cap in an unscrewing direction until the child-resistant means engage and, in doing so, may relieve the downward sealing thrust of the threads sufficiently so that it will leak.

Even if the counter rotation of the cap does not allow the cap to elevate greatly relative to the container neck, because most liners are not perfectly resilient, and because the finish on the end of the container neck may not be perfect, the counter rotation by the child up to the point of engagement of the locking means may result in the cap being loose on the container neck.

As an illustration of the problem, in a more or less standard six pitch thread, for every ten degrees of rotation of the cap relative to the bottle there is approximately 0.005 inch change in elevation of the cap. If the tolerances normally encountered in the fabrication of such caps and bottles are cumulated, then a 120° retrograde rotation may be possible before the locking means abut, which will permit at least 0.055 inch elevation of the cap relative to the neck of the container.

It is also necessary to realize that when the cap is being threaded on to the container neck, the top surfaces of the cap threads bear against the under surfaces of the container neck threads. This thrusts the cap downwardly as it is rotated. Therefore, if the cap is rotated on to the container neck until it is tight, and, particularly, when it must be rotated beyond the angular position at which the child-resistant means engage, the resulting problem is created.

With a normal screw type cap, when a person then endeavors to rotate the cap in a counter direction, i.e., seeking to unscrew the cap, the upper surfaces of the cap threads gradually disengage from the lower surfaces of the container neck threads and the cap is free to move up and down some fraction of an inch until continued rotation in the opening direction causes the engagement of the under surface of the cap threads with the upper surface of the container neck threads. This results from the fact that the vertical thickness of the threads on the interior of the cap cannot be equal to the vertical space between the threads on the container neck. In order for the cap to be able to be screwed on to and off of the container, there must be clearance between the engaging surfaces of the two sets of threads and usually, to avoid unnecessary cap and bottle thread material, this clearance is a significant percentage of the space between the threads, say 35° or 0.06 inch.

It is in the interval between these two engagements that the cap is loose on the container neck and, with the six pitch thread, the cap may rotate 130°, 140°, or even 150° before the elevating engagement of the lower surfaces of the cap threads and the upper surfaces of the container neck threads takes place. Rotation even of a few degrees, say 10° or 15°, may be enough to result in a leaking container.

It is, therefore, the principal object of the instant invention to provide a screw type cap for the threaded neck of a container for liquids which is provided with a secondary cooperating means on the cap and container neck which hold the cap down in sealed position with sufficient force to prevent leakage from the container even when the cap has been rotated in an opening direction a distance such that it would otherwise have vertical play and a leaker might result.

It is a further object of the invention to provide a cap and a container neck equipped with cooperating cam means which exert downward thrust on the cap even when the cap has been rotated in an opening direction so as to disengage the upper surfaces of the cap threads and the lower surfaces of the container neck threads, thus holding the cap downwardly, holding the cap liner against the end of the container neck and maintaining the container in liquid sealed condition until it is rotated far enough for the lower surfaces of the cap threads to engage the upper surfaces of the container threads after which further rotation disengages the cooperating cam means and the cap then can be further unscrewed and removed.

DESCRIPTION OF PREFERRED EMBODIMENTS

While a cap and neck finish, in combination, which embody the invention, have great utility in insuring liquid-tight sealing of ordinary containers having threaded necks, the invention will be illustrated as it is applied to a liquid container also comprising child-resistant locking means.

Figure 1:
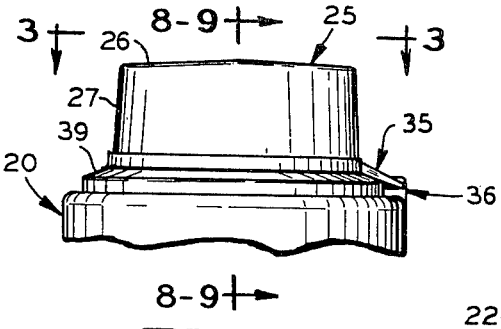
FIG. 1 is a fragmentary view in side elevation showing a cap and container embodying the invention with the cap in closed position on the container.
Figure 2:
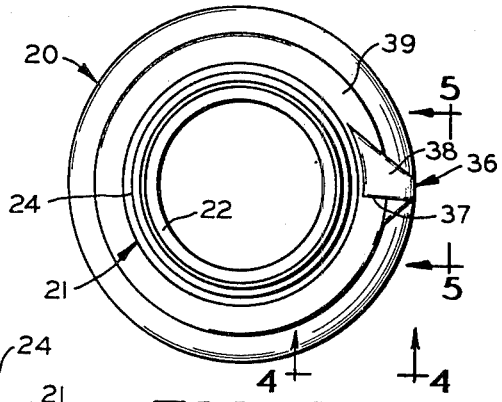
FIG. 2 is a top plan view of the container with the cap removed and showing the locking lug.
Figure 3:
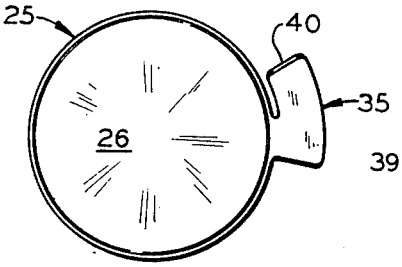
FIG. 3 is a top plan view of the cap showing the appearance of the locking tab.
Figure 4:
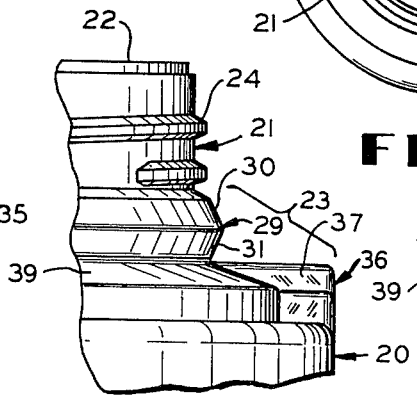
FIG. 4 is a fragmentary side view in elevation taken from the position indicated by the line 4—4 of FIG. 2 and shown on an enlarged scale.
Figure 5:
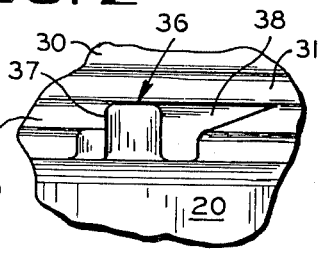
FIG. 5 is a fragmentary view in elevation taken from the position indicated by the line 5—5 and shown on the same scale as FIG. 4.
Figure 6:
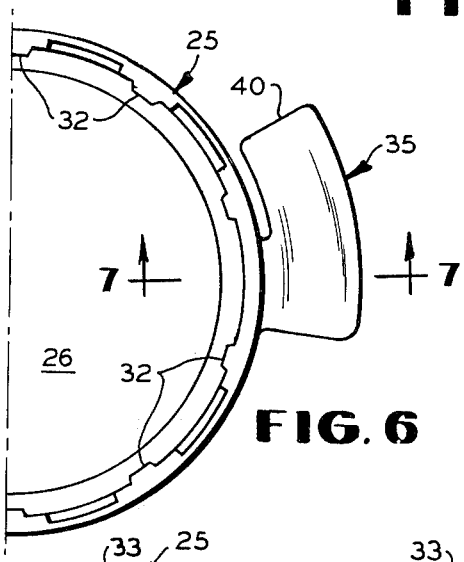
FIG. 6 is a bottom half-view of the cap shown on the same scale as FIGS. 4 and 5.
Figure 7:
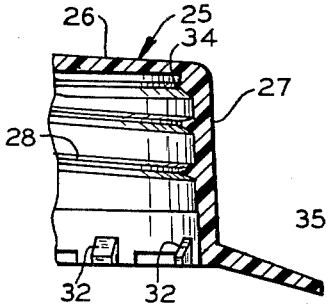
FIG. 7 is a fragmentary vertical sectional view taken along the line 7—7 of FIG. 6.

According to the invention, a container 20, fragmentarily illustrated in FIG. 1, has a threaded neck 21 with an open end defined by an annular lip 22. The neck 21 is connected to the container 20 by a particularly configured shoulder portion encompassed within the bracket 23 as shown in FIGS. 2 and 4. The neck 21 has an external thread 24.

A cap 25 has a disc-like top 26 and an annular skirt 27 depending from the top 26. The inner surface of the cap skirt 27 has threads 28 which mate with the threads 24 on the container neck 21.

The shoulder portion 23 comprises the first one of a pair of cooperating surfaces, the first being formed as a part of a radially outwardly protruding annulus 29 (see particularly FIG. 4) which consists of an outwardly extending, upper frusto-conical surface 30 which meets at its larger diameter the larger diameter of a return frusto-conical lower surface 31. The radially larger portion of this first cooperating surface is, of course, the apex of the two inclined surfaces 30 and 31. The annulus 29 on the container neck 21 cooperates with what is illustrated as a series of circumferentially spaced, inwardly protruding cam lugs 32. The upper surfaces of the lugs 32 lie on and define portions of a second generally frusto-conical surface, the smaller diameter of such defined surface being less than the larger diameter of the annulus 29 on the neck 21. Although illustrated as separate spaced lugs 32, it will, of course, be appreciated that this second cooperating surface defined by the upper inwardly inclined surfaces of the lugs 32 may also be a continuous annular surface extending circumferentially around the inner side of the cap skirt 27, such surface extending the surfaces of the lugs 32 and functioning in the same fashion as the separate surfaces of the lugs 32 which define this functional second surface.

It should also be born in mind that in any screw type cap and neck, the vertical heights of the cap threads 28 must be less than the vertical spacing between the neck threads 24 in order that the cap can be screwed on to and off of the neck 21. In order to insure that the spacings are as just described, it is necessary in manufacture to dimension these parts so that even when when their manufacturing tolerances cumulate in the wrong direction, the cap will not be bound up against rotation by its threads 28 being wedged between the neck threads 24. As a result of these requirements and manufacturing tolerances, when the cap 25 is being turned on to the neck 21 either by an automatic capping machine or by a person restoring the cap 25 on to the container 20, the upper surfaces of the cap threads 28 bear against the under surfaces of the neck threads 24 thus to exert downward thrust to carry the cap downwardly into sealing position on the neck 21 with sufficient tightness to squeeze a liner 33 or other sealing means into engagement with the open end of the container neck 21 or its lip 22.

In the illustrated embodiment, the liner 33 is a disc of compressible but resilient material so that when the cap 25 is turned downwardly on to the neck 21, the torque-responsive clutch of a capping machine will stop rotating the cap 25 relative to the container 20 at such point that sufficient force is exerted against the liner 33 and, in turn, against the lip 22 of the container neck 21, to insure a liquid-tight seal. Experience has shown that a force of from about 2 to 5 pounds is necessary to maintain a liquid seal in such an arrangement.

In the illustrated embodiment of the invention, the cap 25 also has at the upper end of its skirt 27 an inwardly protruding retaining lip 34 above which the disc-like sealing liner 33 is snapped prior to assembly of the cap 25 on the neck 21. The presence of the retaining lip 34 eliminates the necessity for adhering or otherwise attaching the liner 33 to the top 26 of the cap 25 and leaves it free to rotate relative to the cap 25 with an advantageous result later to be described.

Figure 9:
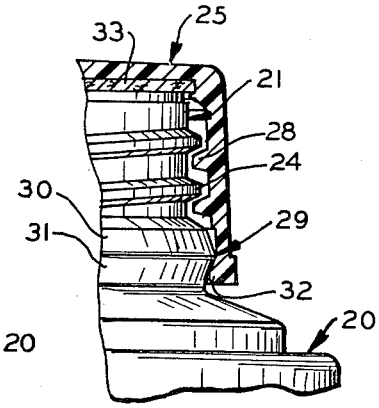
FIG. 9 is a view similar to FIG. 8 but illustrating how the secondary camming means holds the cap in its sealed position even after is has been rotated toward opening.

After the cap 25 has been turned down on to the neck 21 to a distance sufficient to insure liquid-tight sealing of the container, and the upper surfaces of the cap threads 28 are engaged with the under surfaces of the neck threads 24, the container remains in liquid-tight sealing. Upon the first occasion of endeavoring to open the container, i.e., by turning the cap 25 in a retrograde or, usually, counter-clockwise direction, only a relatively few degrees of angular rotation are necessary to disengage the bearing surfaces just described and to create a situation as illustrated in FIG. 9 where these previously bearing surfaces of the mating threads are no longer in contact. In an ordinary cap, at this position, the cap is free to move up and down relative to the container neck a distance determined by the differences in the dimensions described above and/or by the tolerances in manufacture. This movement frequently is sufficient to allow the container to leak.

Figure 8:
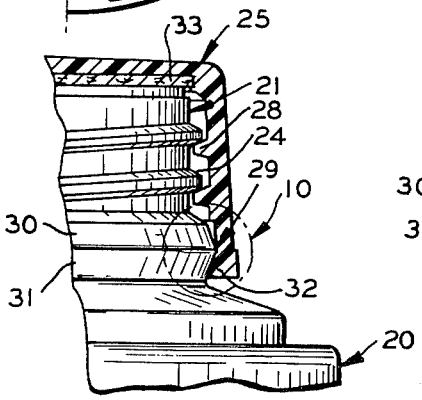
FIG. 8 is a fragmentary half-view in vertical section showing the cap and container with the cap threaded entirely on to the container in sealed position.
Figure 10:
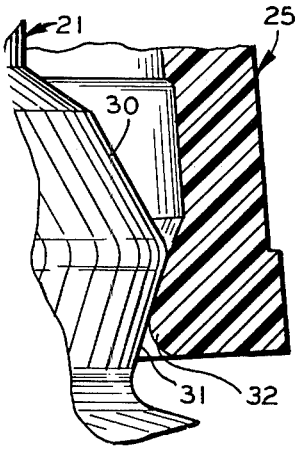
FIG. 10 is a greatly enlarged fragmentary view in section showing the detail of that portion of FIG. 8 included within the circle labeled 10.

In a threaded cap and neck finish according to the invention, however, the cap 25 is held in liquid sealing position even after being rotated through an angle of a substantial number of degrees in a retrograde or counter-clockwise direction by the cooperative action of the surface 31 on the container neck 21 and the surface defined by the upper faces of the lugs 32 on the cap skirt 27. As can best be seen by reference to FIGS. 8, 9 and 10, these two generally frusto-conical surfaces cooperate to retain the cap in its lower-most position even after the upper surfaces of the cap threads 28 have become separated from the lower surfaces of the neck threads 24 due to the retrograde rotation.

Of course, continued retrograde rotation of the cap 25 relative to the container neck 21 eventually engages the lower surfaces of the cap thread 28, with the upper surface of the neck thread 24, and, as the cap continues to be rotated, this exerts upward thrust sufficient in force to pull the surface of the lugs 32 against the cooperating surface 31 on the neck 21, expanding the lower positions of the cap skirt 27 radially outwardly and pulling the cap 25 upwardly until the lesser diameter of the cooperating surface on the cap 25 passes the greater diameter of the cooperating surface on the container neck 21. Thereafter, the cap merely is unscrewed in conventional manner.

The cooperative actions of the mating threads of the threaded cap and container neck and the two cooperating substantially frusto-conical surfaces thus results in what might be called a combination screw and "snap on" cap. The "snap-on" feature continues to exert sufficient retaining force on the cap 25 to hold it in liquid sealing condition even after partial retrograde rotation of the cap has disengaged the threads so they no longer can accomplish that result.

In addition, a cap as illustrated in FIGS. 1–10 and according to an improved embodiment comprises cooperating means by which that cap is rendered child-resistant. These child-resistant means comprise a radially outwardly extending tab generally indicated by the reference No. 35 and an abutment generally indicated by the reference No. 36 which is included within the special shoulder portion 23 of the container. The abutment 36 has a substantially vertical face 37 and a tapered rear surface 38. As can best be seen by comparing FIGS. 7 and 4, in this illustrated embodiment the tab 35 is angularly downwardly inclined relative to the horizontal and the shoulder portion 23 of the container 20 has a similar downwardly angled annular surface 39 which is frusto-conical in general configuration and tapered to substantially the same degree as the tab 35.

When the cap 25 is turned downwardly on to the neck 21 and approaches its liquid sealing position, the action of the cooperating camming surfaces 31 and 32 is effective to expand the lower portion of the skirt 27 outwardly so that they can pass each other and the under surface of the tab 35 approaches contact with the tapered surface 39 of the container shoulder 23. The angular positions of both the abutment 36 and the tab 35 on the shoulder portion 23 and cap skirt 27, respectively, are such that the cap will ordinarily reach liquid sealing position on the neck 21 after a trailing edge 40 on the tab 35 has passed the face 37 of the abutment 36. Again, because of tolerances in manufacture, it cannot be determined precisely that the cap will be in liquid sealing contact with the container immediately upon the passage of the trailing edge 40 of the tab 35 beyond the face 37 of the abutment 36. It only is necessary that the trailing edge 40 shall have passed the abutment face 37 when the cap reaches sealing position on the container neck 21. Therefore, in most instances the tab 35 will have been turned beyond its child-resistant engagement with the abutment face 37 by the torque-responsive chuck of an automatic capping machine or by a person restoring the cap, so that it will be spaced a considerable angular direction therefrom.

When a small child endeavors to open a container with harmful or dangerous contents, he may be able to turn the cap 25 in a retrograde direction until the locking tab 35 engages the abutment 36. It has been found that a small child, beneath the age of 6 or so, is incapable, however, of comprehending the necessity for lifting the tab 35 to a height sufficient to disengage it from the abutment 36 to allow continued retrograde movement.

Nevertheless, in an ordinary child-resistant cap having cooperating tab and lug, this retrograde movement which the child can accomplish often is sufficient to free the retaining surfaces of the cap and container threads enough so that the cap can move up and down a distance sufficient to result in a leaking container. By reason of the invention herein described, however, the action of the two cooperating surfaces, i.e., the surface 31 of the shoulder portion 23 and the surface defined by the upper faces of the cap lugs 32, exerts sufficient force downwardly on the cap 25 to maintain the liner 33 in liquid sealing contact with the lip 22 on the container neck 21.

The fact that in a child-resistant cap embodying the invention the liner 33 preferably is not sealed or adhered to the cap top 26, but is free to rotate relative thereto, has a further advantage. Often in the manufacture of containers, the annular surface of the neck lip 22 is not perfectly smooth. Irregularities in that surface are embossed into the under surface of the liner 33 when the cap 25 is turned downwardly on to the neck 21 in liquid sealing condition. Therefore, if the cap 25 is turned in a retrograde direction from its sealing position and backwardly to the child-resistant contact of the tab 35 and abutment 36, the liner 33 is retained tightly against the neck lip 22 by the cooperation of the two camming surfaces 31 and 32 so that the embossements in the lower surfaces of the liner 33 remain in position on the irregularities of the neck lip 22, again eliminating an otherwise likely pathway for leakage.

Figure 11:
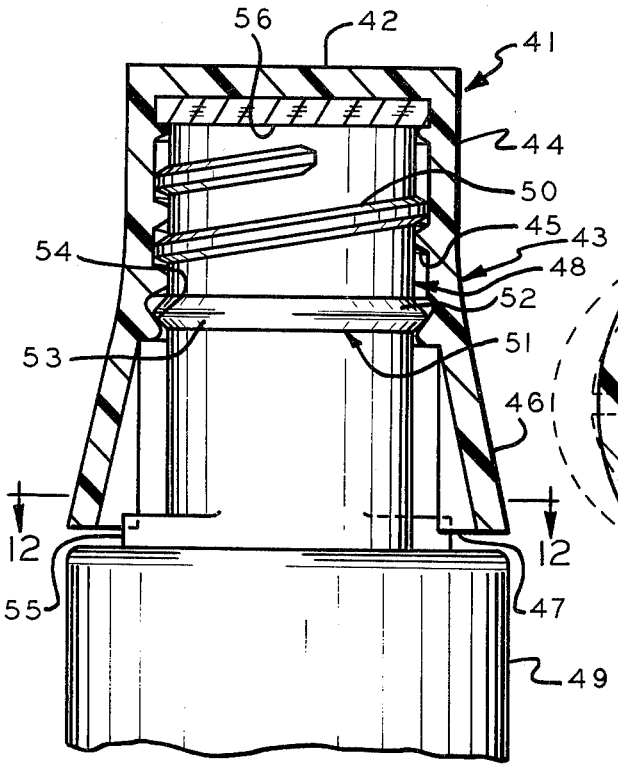
FIG. 11 is a fragmentary vertical sectional view of a second embodiment of the invention.
Figure 12:
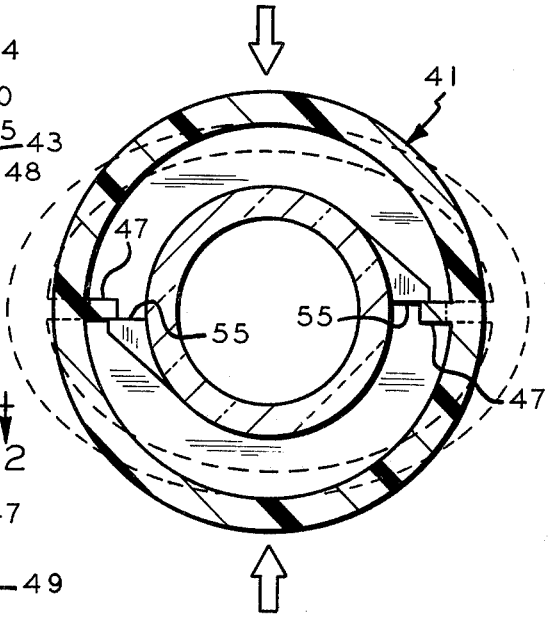
FIG. 12 is a horizontal sectional view taken along line 12—12 of FIG. 11.

In a second embodiment of the invention illustrated in FIGS. 11 and 12, a cap 41 has a top 42 and skirt 43 which includes two portions. The skirt 43 has a cylindrical portion 44 with a thread 45 on its interior surface and a flaired lower portion 46 which has child-resistant locking lugs 47 and at its lower margin. The cap 41 is shown in FIG. 11 as being threaded onto a neck 48 of a container 49. The upper portion of the neck 48 has an external thread 50 which mates with the cap 45 so that when the cap 41 is on the neck 48, the threads 45 and 50 are interdigitated, i.e., at least a substantial length of the neck thread 50 extends between adjacent turns of the cap thread 45.

As explained earlier, of course, because of the necessity for clearance between the threads 50 and 45 and by reason of manufacturing tolerances and their possible cummulation, the two sets of threads, while remaining interdigitated, may not stay in contact in all positions of the cap 41 relative to the container neck 48. Thus, in FIG. 11, it is assumed that the cap 41 has been turned slightly in a retrograde direction from its tightest position on the neck 48 so that the upper surface of the cap thread 45 actually has disengaged from the lower surface of the neck thread 50 but the lower surface of the cap thread 45 in its upper turns has not yet engaged the upper surface of the neck thread 50. It is during this period of thread disengagement that the improvement embodying the invention becomes effective.

As in the earlier described embodiment of the invention, the container neck 48 has an outwardly protruding annulus 51 having an upper outwardly inclined surface 52 and a lower, generally frusto-conical return surface 53. At a distance down from the cap top 42 such that it will be outwardly deflected by the upper surface 52 of the annulus 51 and will snap in beneath the lower surface 53 of the annulus 51, the cap 41 has an inwardly protruding lip or series of angular lugs 54 which have upper surfaces that also are inclined downwardly and inwardly relative to the axis of the container neck 48.

The cap 48 is illustrated in FIG. 11 and 12 as being in its child-resistant position in which the cap lugs 47 are engaged behind respective abutments 55 formed at the base of the container neck 48. This illustrates a condition frequently encountered in a child-resistant cap, and discussed above, wherein the cap 41 has been turned down onto the neck 48 into full sealing position i.e., farther onto the neck than the position illustrated in FIGS. 11 and 12, and a small child has endeavored to remove the cap 41 by turning it in a retrograde direction until the child-resistant lugs 47 and abutments 55 engage. In a child-resistant cap not embodying the invention, in such a condition, with the surfaces of the cap and neck threads 45 and 50 disengaged from each other, the cap 41 would be free to move up and down slightly and the container probably would leak. However, because of the improvement embodying the invention, which consists of the complementary surfaces of the annulus 51 on the neck 48 and retaining lugs 54 on the interior of the cap skirt 43, the cap 41 is held down in sealing position with its liner 56 still tightly pressed against the end of the container neck 48 even when the cap is turned backwardly i.e., in retrograde direction as described.

In this embodiment of the invention, the child-resistant locking elements 47 and 55 may be disengaged by squeezing hte flaired lower portion 46 of the cap skirt 43 inwardly as indicated by the arrows in FIG. 12 to the dotted line positions shown in FIG. 12 thereby moving the cap locking lugs 47 outwardly beyond the extremities of the neck abutments 55. After this deformation, the cap 41 may be unscrewed by turning it further in the retrograde direction as if it were an ordinary cap and the lower surface of the cap thread 45 moves into engagement with the upper surface of the neck thread 50 so that turning the cap to remove it exerts upward force on the cap sufficient to result in flaring the cap skirt 43 outwardly and the cap lugs 54 pass the neck annulus 51.

Figure 13:
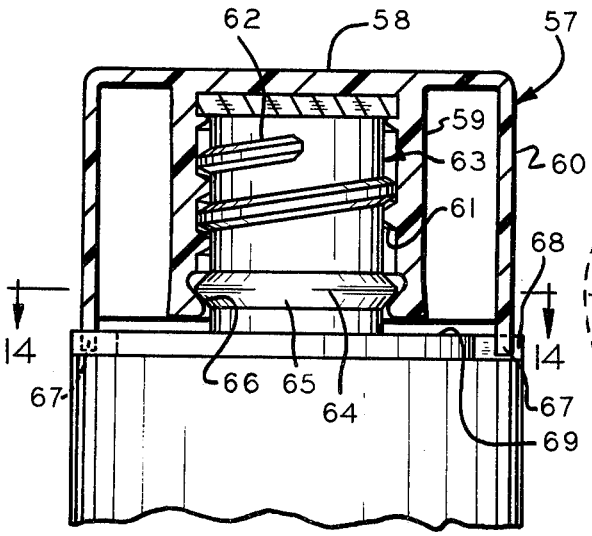
FIG. 13 is a view similar to FIG. 11 but showing a third embodiment of the invention.
Figure 14:
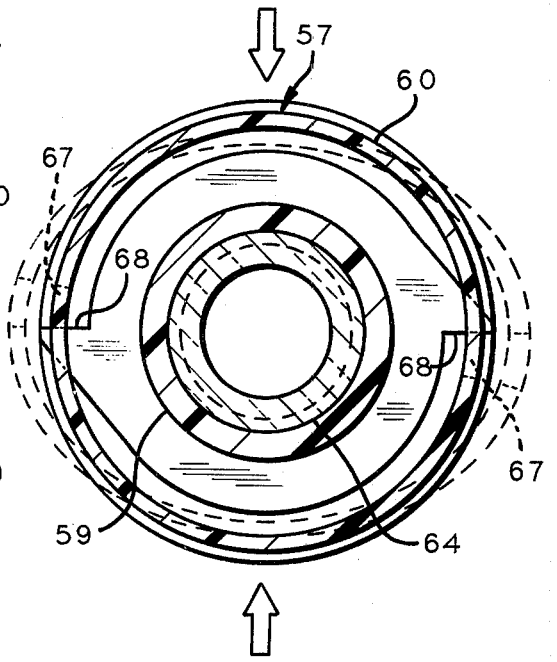
FIG. 14 is a horizontal sectional view taken along the line 14—14 of FIG. 13.

The embodiment of the invention illustrated in FIGS. 13 and 14 is similar to that of FIGS. 11 and 12. A cap 57 has a top 58 and two concentric skirts 59 and 60. The inner skirt 59 has a thread 61 on its inner surface which interdigitates between and mates with a thread 62 on a container neck 63. In common with earlier described embodiments of the invention, the neck 63 also has an annulus 64 having a lower frusto-conical surface 65 which cooperates with lugs 66 located at the bottom of the inner cap skirt 59 in the manner already described.

Again, in FIGS. 13 and 14, the cap 57 is shown in a position turned in a retrograde direction slightly away from its most tightly sealed position and illustrating the disengagement of the surfaces of the cap thread 61 and neck thread 62 which would otherwise result in a leaking container were it not for the coaction of the surface 65 and the lugs 66 according to the invention.

In this embodiment of the invention, child-resistant tabs 67 are located at the bottom margin of the outer skirts 60 and cooperate with abutments 68 on a shoulder 69 located at the base of the container neck 63. As in the case of the embodiment illustrated in FIGS. 11 and 12, the cap of the embodiment of FIGS. 13 and 14 may be removed by squeezing inwardly as shown by the arrows in FIG. 14.

Figure 15:
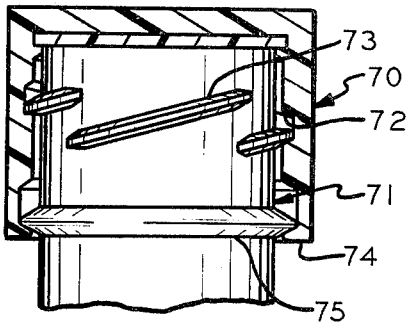
FIG. 15 is a fragmentary vertical sectional view of a fourth embodiment of the invention, illustrating the particular cap in its sealed position.
Figure 16:
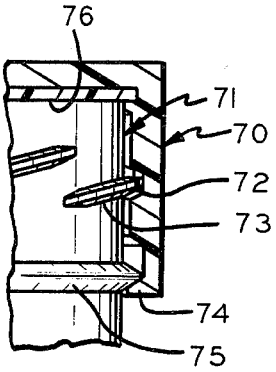
FIG. 16 is a fragmentary view, similar to a portion of FIG. 15, but showing the cap of this embodiment after it has been rotated in retrograde direction to disengage the thread surfaces shown engaged in FIG. 15 but not yet engaging the thread surfaces to remove the cap.
Figure 17:
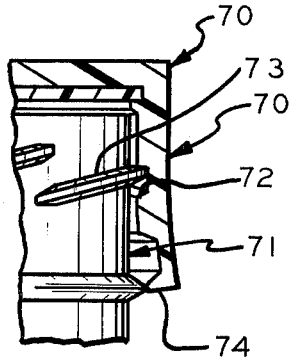
FIG. 17 is a view similar to FIG. 16 but showing the cap rotated still farther in a retrograde direction and illustrating how the cap is removed by continued rotation.

The embodiment of the invention illustrated in FIGS. 15–17, inclusive, consists of a cap 70 and a container neck 71 which have mating, so-called, "multi-start" threads. Cap threads 72 and neck threads 73 are short, helically formed individual elements, in this case there being four neck threads 73 and four cooperating cap threads 72. However, as in the earlier described embodiments, where the thread on the cap and the thread on the neck were single-start threads, in this embodiment of the invention, the threads 72 and 73 remain in interdigitated condition even when their surfaces are out of contact during the period described above between the sealed position (FIG. 15) and the almost open position (FIG. 17). FIG. 15 shows the cap 70 in its closed position with the upper surfaces of its threads 72 tightly engaged with the lower surfaces of the neck threads 73 and its retaining lugs 74 engaged with the lower surface of a neck annulus 75. FIG. 16 shows the cap 70 turned slightly in a retrograde direction relative to the container neck 71, the position being that in which the upper surfaces of the cap threads 72 have disengaged from the lower surfaces of the neck threads 73 but the bottom surfaces of the cap threads 72 have not yet engaged with the upper surfaces of the neck threads 73. In this position, as in the earlier described embodiments of the invention, the cooperating retaining means consisting of the cap lugs 74 and container annulus 75 still retain the cap 70 down tightly in sealed position with its liner tightly squeezed against the end of the container neck 71.

Further retrograde rotation of the cap 70 relative to the neck 71 is illustrated in FIG. 17 where it can be seen that the lower surfaces of the cap threads 72 have been rotated into engagement with the upper surfaces of the neck threads 73 and the cap 70 has been moved upwardly thereby. This causes the complementary surfaces of the lugs 74 and annulus 75 to force the lugs 74 radially outwardly, expanding the lower portion of the skirt of the cap 70 and allowing the cap 70 to be removed by further retrograde rotation.

When the cap 70 is turned back down onto the neck 71, the contact between the upper surfaces of the cap threads 72 and the lower surfaces of the neck threads 73 causes the cap 70 to be thrust downwardly as it is rotated, expanding the lower margin of the skirt of the cap 70 and forcing the cap lugs 74 past the container neck annulus 75 until the sealed position illustrated in FIG. 15 is reached.

Figure 18:
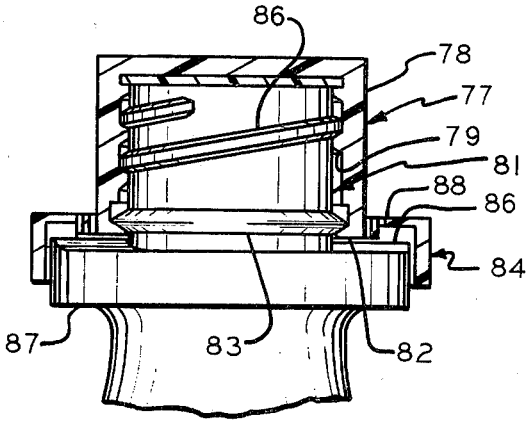
FIG. 18 is a fragmentary vertical sectional view similar to FIGS. 11, 13 and 15 and showing a cap embodying the invention and provided with a child-resistant locking means.
Figure 19:
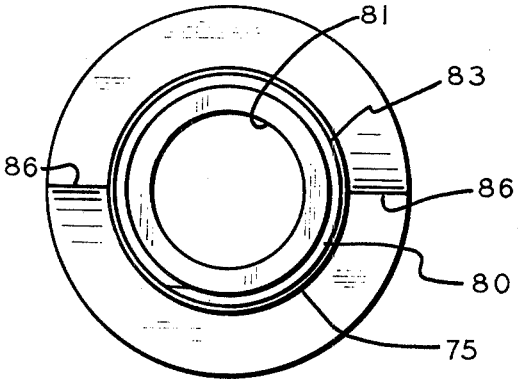
FIG. 19 is a top plan view of the neck and upper portion of a container according to the embodiment of the invention illustrated in FIG. 18.
Figure 20:
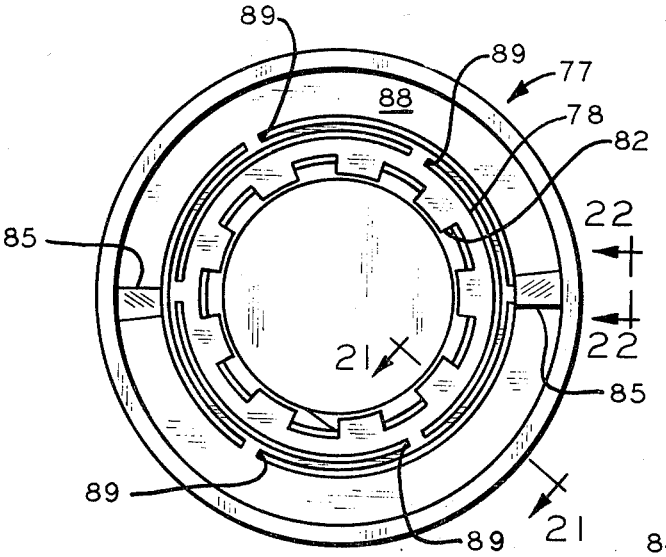
FIG. 20 is a bottom plan view of the cap of the combination illustrated in FIG. 18, shown on a slightly enlarged scale.

A fifth embodiment of the invention is illustrated in FIGS. 18–22, inclusive, and comprises not only the improvement according to the invention but a different type of child-resistant locking feature. In this embodiment of the invention, a cap 77 has a single skirt 78 which has an internal thread 79. The cap thread 79 mates and interdigitates with a thread 80 on a container neck 81. As in the earlier described embodiments of the invention, the lower margin of the cap 77 has inwardly extending lugs 82 (see also FIG. 20 and 21) which cooperate with an annulus 83 formed on the container neck 81. These cooperating lugs 82 and annulus 83 function according to the invention to insure that the cap 77 remains in sealed condition relative to the neck 81 even though it may be turned in a retrograde direction backwardly from its most tightly sealed position to a child-resistant position which is illustrated in FIG. 18.

The child-resistant features comprise an axially deformable skirt 84 which has two depending locking lugs 85 so constructed, designed and located as to engage two abutments 86 formed on the upper surface of a generally annular shoulder 87 located at the lower end of the container neck 81. As can best be seen by reference to FIGS. 20 and 21, the skirt 84 has a horizontally extending annular flange 88 that is connected to the lower margin of the cap skirt 78 by a series of narrow flexible webs 89.

Figure 21:
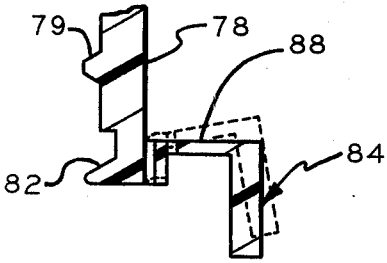
FIG. 21 is a fragmentary vertical sectional view taken along the line 21—21 of FIG. 20.
Figure 22:
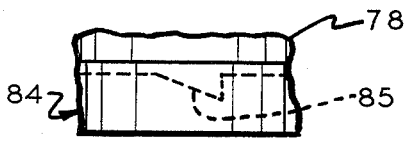
FIG. 22 is a fragmentary view in elevation taken from the position indicated along the line of 22—22 of FIG. 20.

When the cap 77 is rotated downwardly onto the container neck 81, the locking lugs 85 are turned around until they snap over the abutments 86 on the shoulder 87, the flexibility of the webs 89 allowing the entire skirt 84 to flex upwardly as illustrated in FIG. 21. Even if the cap 77 is turned beyond child-resistant position, either by an excessive torque applied hereto by an original capping machine or by a person restoring the cap 77 onto the container neck 81, the cooperating lugs 82 and annulus 83 retain the cap 77 in liquid sealed condition even when it is turned in a retrograde direction back to the engagement of the child-resistant locking lugs 86 and abutments 86 (position illustrated in FIG. 18). However, when an adult or older child desires to actually remove the cap 77 from the container neck 81, he grasps the outer margin of the depending skirt 84 and flexes it upwardly, as illustrated in FIG. 21, to elevate the locking lugs 85 above the abutments 86. He then rotates the cap 77 on the container neck 81 in the same fashion as that earlier described with respect to the other embodiments of the invention illustrated.

While the particular material from which caps embodying the invention are manufactured is not critical to the invention, it must be a resilient material, rather tough in nature, so that the margins of the various caps where the cooperative retaining lugs are positioned will flex outwardly both during the screwing of the cap onto the respective container neck and during its removal. It has been found that either polypropylene or high density polyethylene are satisfactory materials from which to mold caps embodying the invention. However, other materials also may be utilized if desired and if they possess the necessary stiffly flexible and resilient characteristics.

It should be noted that in the preceding specification and in the claims which follow, the term "interdigitated" has been utilized to define a situation wherein the cooperating, mating thread or threads of the caps and container necks may not be in actual contact with each other but nevertheless are in embracing relationship with the neck threads extending between rhe walls of the cap threads at all times. Actual contact between the cap and neck threads exists, of course, during all times except for that portion of retrograde rotation when the cap is being turned relative to the container neck and, because of the tolerances described, the upper surfaces of the cap threads have disengaged from the lower surfaces of the neck thread or threads but the lower surfaces of the cap thread or threads have not yet engaged with the upper surfaces of the neck threads or threads.

Having described my invention, I claim:

1. In the combination of a liquid container having a threaded neck and a cap therefor in which combination there are cooperating threads on said neck and said cap which are interdigitated with each other when said cap is turned onto said neck and in which the cross sectional thickness of each thread on said cap is less than the distance between the threads on said neck between which said cap thread extends when said cap and neck threads are interdigitated, said cap being thrust downwardly toward and to sealed position upon rotation thereof with the upper surface of each cap thread bearing on the under surface of an engaged neck thread and said cap being removable from said container neck by retrograde rotation, first to disengage such cap thread upper surface from such neck thread under surface and, upon further retrograde rotation of said cap, to engage the under surface of the cap thread with the upper surface of the next neck thread for thrusting said cap upwardly upon further retrograde rotation thereof, the improvement consisting of, cooperating generally frusto-conical surfaces on said neck and said cap, one of said frusto-conical surfaces being directed radially outwardly relative to the axis of said container neck and the other of said frusto-conical surfaces being complementary thereto, the larger diameter portion of the first of said frusto-conical surfaces being greater than the smaller diameter portion of the second of said frusto-conical surfaces, said cooperating frusto-conical surfaces being spaced axially from said neck and cap threads such distances that such larger and smaller diameter portions are forced past each other during rotation of said cap onto said neck prior to said cap reaching sealed position and are forced past each other in removal direction after retrograde rotation of said cap to engage the under surface of the cap thread with the upper surface of the bottle thread and continued retrograde rotation of said cap.

2. Leak preventing means for a liquid container having an externally threaded neck and a cap therefor which has an internally threaded neck, the threads on said neck and cap being so designed as to remain in interdigitated relationship while said cap is turned onto said neck to closed position and while said cap is turned in retrograde direction and off of said neck to removable position, said means consisting of cooperating annular snap-over rims on said neck and said cap skirt so positioned on said neck and said cap as to be forced past each other when said cap is turned down onto said container prior to said cap reaching closed position thereon and to be forced past each other in the opposite direction when said cap is rotated in retrograde direction.

3. Leak preventing means according to claim 2 in which the snap-over rims consists of an upwardly and outwardly extending annular surface on the bottle neck and an inwardly and downwardly extending annular surface on the cap skirt.

4. A combination container and cap according to claim 1 having child-resistant locking means consisting of interengaging lugs on said container at the lower end of the container neck and on the lower margin of said cap.

5. A combination container and cap according to claim 4 in which the cap has an annular flexible skirt extending beyond the threads and the cooperating frusto-conical surfaces and the lugs are located at the margin of said skirt.

6. A combination container and cap according to claim 4 in which the cap has two concentric skirts, the threads being located on the inner surface of the inner one of said skirts and the child resistance lugs being located at the margin of the outer one of said skirts.

* * * * *